US005564818A

United States Patent [19]

Grossman et al.

[11] Patent Number: 5,564,818

[45] Date of Patent: Oct. 15, 1996

[54] LIGHTING SYSTEM

[75] Inventors: Steven H. Grossman, Rockville; Richard E. Grossman, Bethesda, both of Md.

[73] Assignee: Neon and Cathode Systems, Gaithersburg, Md.

[21] Appl. No.: 103,591

[22] Filed: Aug. 9, 1993

Related U.S. Application Data

[63] Continuation-in-part of Ser. No. 879,878, May 7, 1992.

[51] Int. Cl.[6] ..... F21S 3/02

[52] U.S. Cl. ..... 362/221; 362/216; 362/219; 362/225

[58] Field of Search ..... 362/151, 219, 362/221, 225, 216, 217, 812; 313/567, 568; 439/235

[56] References Cited

U.S. PATENT DOCUMENTS

| | | | |
|---|---|---|---|
| 1,880,230 | 10/1932 | Beck | 362/225 |
| 1,940,368 | 12/1933 | Page | 439/235 |
| 2,017,273 | 10/1935 | Boucher | 362/221 |
| 2,298,824 | 10/1942 | Darley | 362/219 |
| 2,769,897 | 11/1956 | Rzeszutko | 362/217 |
| 2,922,029 | 1/1960 | Eschelbach et al. | 362/151 |
| 4,554,619 | 11/1985 | Bansbach et al. . | |
| 4,569,004 | 2/1986 | Peterson | 362/219 |
| 4,727,459 | 2/1988 | Palumbo | 313/567 |
| 4,751,434 | 6/1988 | Helling et al. | 362/216 |
| 5,025,355 | 6/1991 | Harwood | 362/812 |

OTHER PUBLICATIONS

"Tubular Lighting Systems—TLS 5" (4 pages).

*Primary Examiner*—Denise L. Gromada
*Assistant Examiner*—Y. Quach
*Attorney, Agent, or Firm*—Dickstein Shapiro Morin & Oshinsky

[57] ABSTRACT

A modular cove lighting system is formed of low voltage, cold cathode light fixtures connected together in parallel. The modular system is capable of providing uniform illumination along its length. The modular system advantageously includes a plurality of straight lamps and at least one curved lamp. Through special matching of ballasts and appropriate lamps, the lamps will dim evenly with each other, regardless of the lengths and shapes of the lamps. A shield is provided for covering bright spots. Multicolor systems formed of one or more light fixtures are also disclosed. A recessed light fixture is also disclosed.

25 Claims, 8 Drawing Sheets

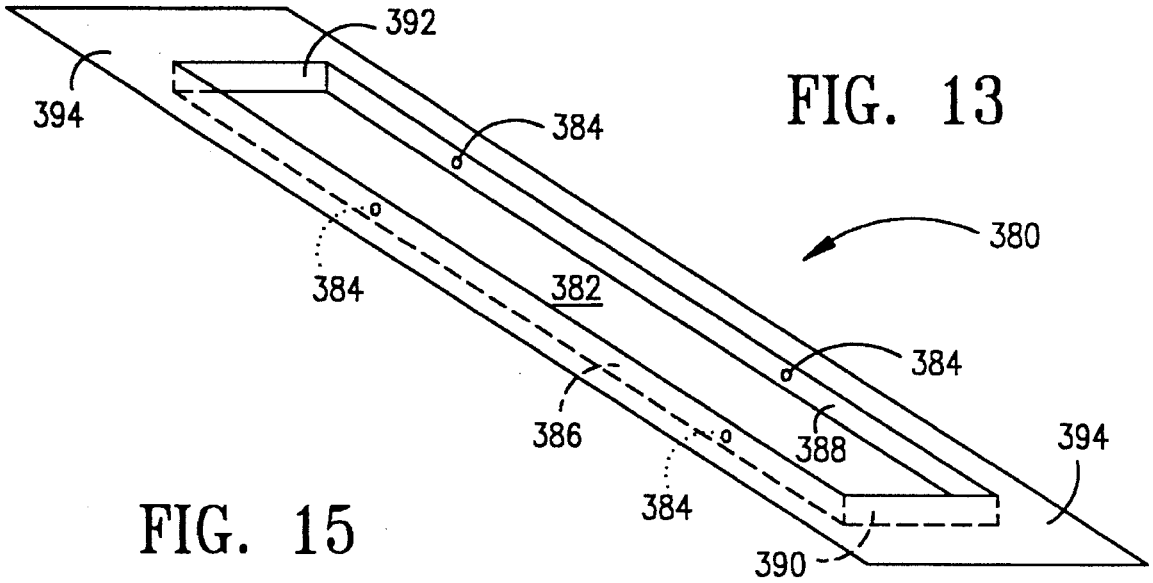
FIG. 13
FIG. 15
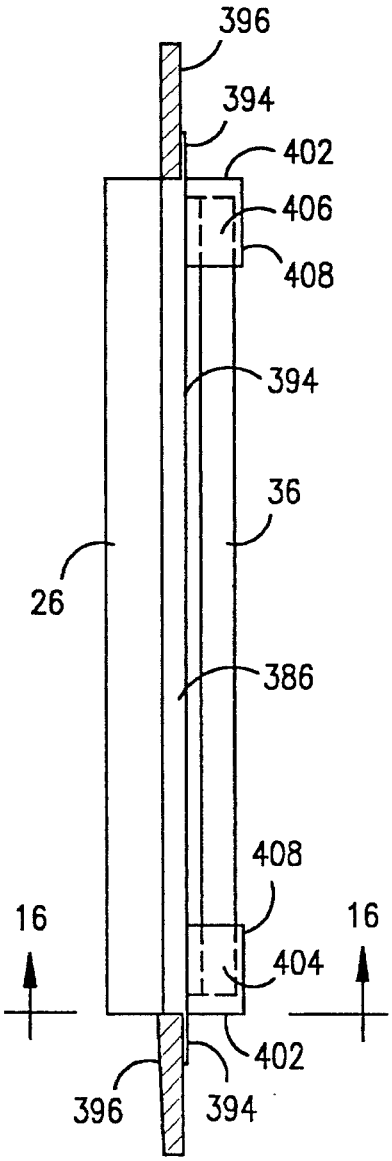
FIG. 14
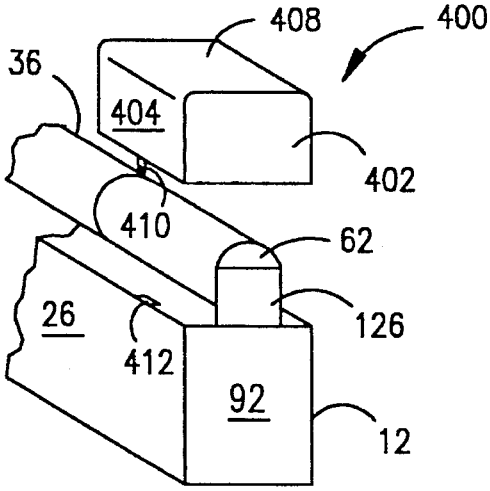
FIG. 16
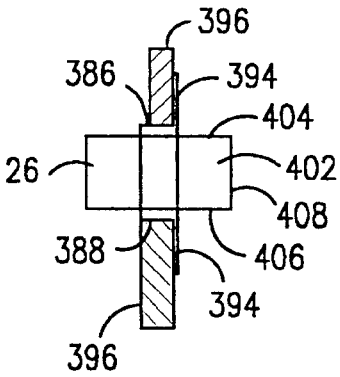

LIGHTING SYSTEM

This is a continuation-in-part of U.S. Pat. No. application Ser. No. 07/879,878, filed May 7, 1992, the entire disclosure of which is incorporated herein by reference.

BACKGROUND OF THE INVENTION

1. Field of the Invention

The present invention relates to lighting systems, such as architectural and environmental lighting systems. The invention especially relates to cove lighting systems for residential applications.

2. Description of the Related Art

In a typical cove lighting system, lighting elements are located in an architectural recess and gently illuminate the wall and/or ceiling space adjacent the recess. Light coves are most frequently located near junctions between walls and ceilings. However, light coves may be placed in other locations, and may be provided in many orientations, including horizontal and vertical.

Cove lighting systems have many applications. For example, cove lighting systems may be used to illuminate book cases, wine and glass racks, furniture, and display cases. Cove lighting systems may be employed anywhere that the introduction of a soft halo of light is desired.

Examples of lighting elements that have been used for cove lighting systems include incandescent bulbs, PL lamps, and standard fluorescent hot cathode lamps. As explained below, all such lighting elements have significant drawbacks.

Incandescent bulbs are energy inefficient. Incandescent bulbs also have a short lifetime. The lifetime of a standard incandescent bulb may be only two thousand hours. Therefore, incandescent bulbs must be replaced frequently. Moreover, incandescent bulbs do not produce uniform illumination. A row of incandescent bulbs produces uneven bright and dark areas of illumination.

A PL lamp is a small diameter U-shaped gas discharge fluorescent lamp. PL lamps, like incandescent bulbs, produce uneven bright and dark areas of illumination. Moreover, PL lamps cannot be dimmed without specialized auxiliary power supplies. Another disadvantage associated with PL lamps is that they are not commercially available in colors other than white. The lifetime of a standard PL lamp is approximately ten thousand hours.

Standard fluorescent (hot cathode gas discharge) lamps are not commercially available in curved configurations suitable for cove lighting applications. Moreover, fluorescent lamps are not commercially available in colors other than white, and are not dimmable without special equipment. The rated lives of commercially available fluorescent lamps are from ten thousand to fifteen thousand hours.

Low voltage cold cathode lamps, in contrast to the lamps discussed above, are especially well suited for cove lighting applications. Cold cathode lamps are dimmable and can be relatively easily fabricated to follow a curved architectural recess without loss of light. Moreover, cold cathode lamps can be ordered in almost any color imaginable, from whites to hot pinks, vibrant blues, purples, and aquas.

A cold cathode lamp is a gas discharge lamp whose electrodes are not heated to the point of thermionic emission. A hot cathode lamp is a gas discharge lamp whose electrodes are heated to the point of thermionic emission. Because of this difference, cold cathode lamps may last much longer than hot cathode lamps. A well manufactured cold cathode lamp may last fifty thousand hours. Unlike regular hot cathode fluorescent lamps, a cold cathode lamp does not lose three hours of its rated lifetime each time it is turned on.

Examples of cold cathode gas discharge lamps are disclosed in U.S. Pat. Nos. 5,155,668 (Tanner) and 4,004,185 (Edmondson et al.), the entire disclosures of which are incorporated herein by reference.

High voltage cold cathode lamps (including conventional neon lamps) have been used for some cove lighting applications with some success. However, high voltage lamps cannot be used in residences. According to the National Electric Code, NEC 410-75A, voltages over one thousand volts are not suitable for residential applications. Standard high voltage cold cathode lamps are particularly hazardous for residential applications. The high voltage operation of such lamps can also cause humming and buzzing noises which are unacceptable for many applications, particularly residential applications.

Another disadvantage with high voltage lamps is that the ends of such lamps electrostatically attract and incinerate dust. The resulting soot accumulates on the ceiling. The higher the voltage, the worse the problem. Eventually, the ceiling has to be repainted to cover the accumulated soot. It may be necessary to repaint the ceiling every year. To avoid the problem of soot accumulation, coves with high voltage lamps may be spaced farther away from the ceiling. However, for architectural and aesthetic reasons, it is generally advantageous to locate a cove as close to the ceiling as possible.

SUMMARY OF THE INVENTION

The present invention overcomes the problems of the prior art by providing a modular system of low voltage, cold cathode light fixtures connected together in parallel, with each fixture having a self-contained ballast, and with each fixture operating at a voltage of no more than about one thousand volts. The modular system may advantageously include a plurality of straight lamps and at least one curved lamp. Some of the straight lamps may be longer than the others.

In a preferred embodiment, the fixtures operate at voltages of no more than about one thousand volts. Particularly advantageous results are achieved when the fixtures are operated at about six hundred volts. Low voltage operation may be achieved by connecting the fixtures together in parallel and by making the diameters of the cold cathode lamps about three-quarters of an inch or greater. These larger diameters are desired so that the ballast voltage will be significant enough to strike an arc within the lamp. Smaller diameter lamps (referred to as "neon lamps," with diameters of about five eighths of an inch and smaller) are far higher in impedance and require voltages far in excess of one thousand volts to strike the arc in a lamp of the same length.

In a preferred embodiment of the invention, the modular system is available as a kit. Modularized, standard lengths of straight fixtures with integral ballasts are provided, along with similarly configured curved fixtures. Each fixture is wired for easy interconnection, one to another. To install the system, the end user simply places the fixtures along the cove or other recess, connects the fixtures to each other and then connects the system to a suitable power supply.

The present invention also relates to a cold cathode cove lighting system for residential use. The system includes a cove connected to a wall. In this aspect of the invention, the lighting system is made up of a plurality of differently configured low voltage lamps supported within the cove. The lamps are preferably overlapped such that the ceiling is substantially uniformly illuminated along the length of the cove.

In one embodiment of the invention, the ballasts for the lamps are located within the fixtures, such that the modular system is very easy to install.

In an alternate embodiment of the invention, the ballasts are located outside the cove, to produce a cove lighting system with a very narrow profile.

The casings for the fixtures may be light weight, easy to handle extruded elements. The ends of the casings may be enclosed by vertical plates. In one aspect of the invention, the casings are provided with side openings for aligning the lamps in the desired staggered relationship.

The invention also relates to a method of manufacturing a uniformly dimmable cold cathode cove lighting system. The method includes the steps of: (1) connecting a ballast to a gas discharge lamp (such as a cold cathode lamp); and (2) varying the composition of the gas within the lamp such that the lamp is dimmed according to a predetermined pattern. The adjustment of the gas composition may be accomplished by changing the make-up of the gas and/or by adjusting the gas pressure.

The invention also relates to a valance for a recessed gas discharge light fixture, including a planar member having an opening for surrounding at least a portion of the light fixture, and positioning means for positioning the planar member with respect to the light fixture. In a preferred embodiment of the invention, the valance may be used to mount the light fixture within a wall or ceiling.

The present invention also relates to a cover for concealing an end of a gas discharge lamp. As described in more detail below, the cover may be removably connectable to a casing with a snap fit.

The present invention also relates to a multi-color gas discharge lamp having a plurality of pre-colored tubular sections spliced together to simultaneously produce different colors.

The present invention also relates to a system having a plurality of different color lamps that can be selectively dimmed to provide different resultant colors.

The present invention also relates to a means for covering an overlapped portion of a staggered gas discharge lamp, to produce smooth indirect illumination (i.e., with substantially no bright spots). The covering means may be C-shaped and resiliently connected to the overlapped tubular lamp portion. In one aspect of the invention, the C-shaped covering means has outwardly turned edges. The turned edges make it easy to position the covering means on the tubular lamp body, and makes it easy to remove the covering means for use with other lamp bodies.

An object of the invention is to provide a safe, attractive, long lasting, and efficient lighting system.

Another object of the invention is to provide a supply of differently configured light fixtures from which fixtures of different lengths and shapes can be selected and used to create a uniform illumination cove lighting system regardless of the linear dimensions of the cove, and regardless of the locations of the cove's corners.

Another object of the invention is to provide a modular package of linear and non-linear low voltage cold cathode light fixtures that can be easily connected together in parallel.

Another object of the invention is to provide a dimmable lighting system with an infinitely variable light output capability.

Another object of the invention is to provide a light fixture system that dims uniformly from fixture to fixture, regardless of the lengths and shapes of the lamps.

Another object of the invention is to provide a lighting system with lamps that have long lives. The system is ideal for use in hard-to-service locations, and will reduce or even eliminate lamp replacement and associated labor costs.

Other objects and advantages of the invention will become apparent from the following detailed description and drawings which illustrate preferred embodiments of the invention.

BRIEF DESCRIPTION OF THE DRAWINGS

FIG. 13 is a perspective view of a valance constructed in accordance with a preferred embodiment of the present invention.

FIG. 14 is an enlarged perspective view showing an end cover.

FIG. 15 is a cross sectional side view of the light fixture of FIGS. 13 and 14 installed within a wall.

FIG. 16 is a cross sectional view taken along the line 16—16 of FIG. 15.

DETAILED DESCRIPTION OF PREFERRED EMBODIMENTS

Figure 1:
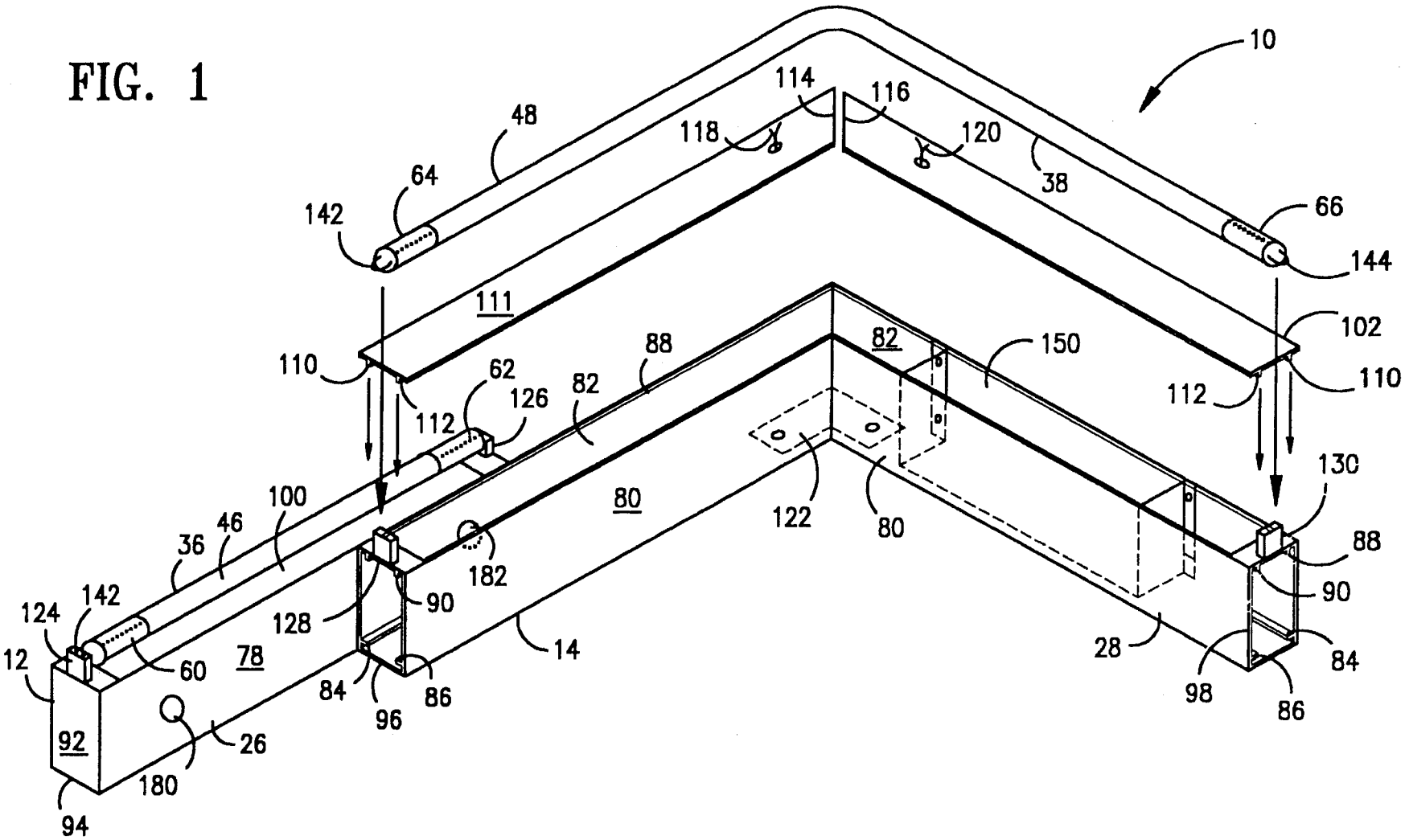
FIG. 1 is a broken away perspective partial view of a lighting system constructed in accordance with a preferred embodiment of the invention.
Figure 2:
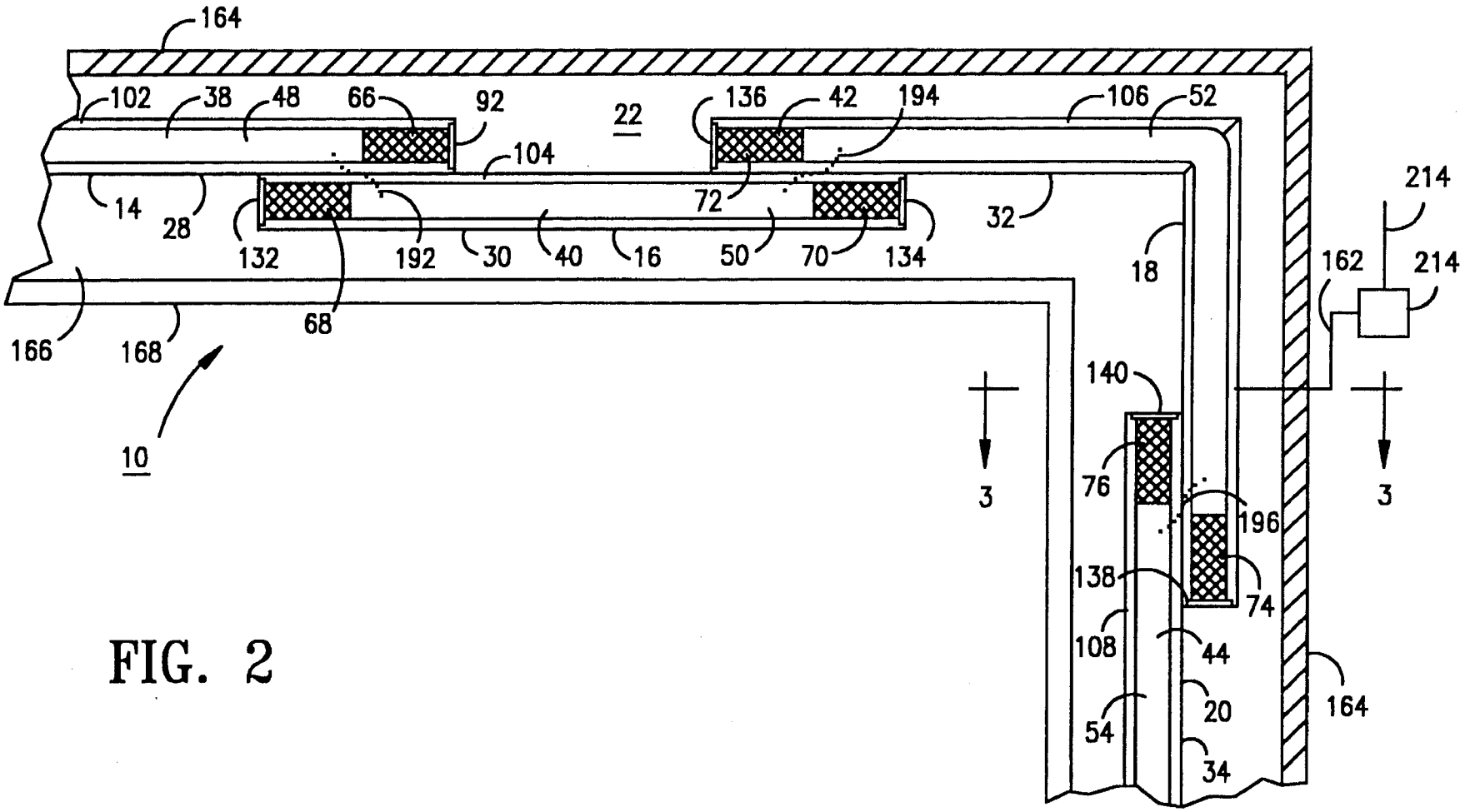
FIG. 2 is a cross sectional plan view of another portion of the lighting system of FIG. 1.
Figure 3:
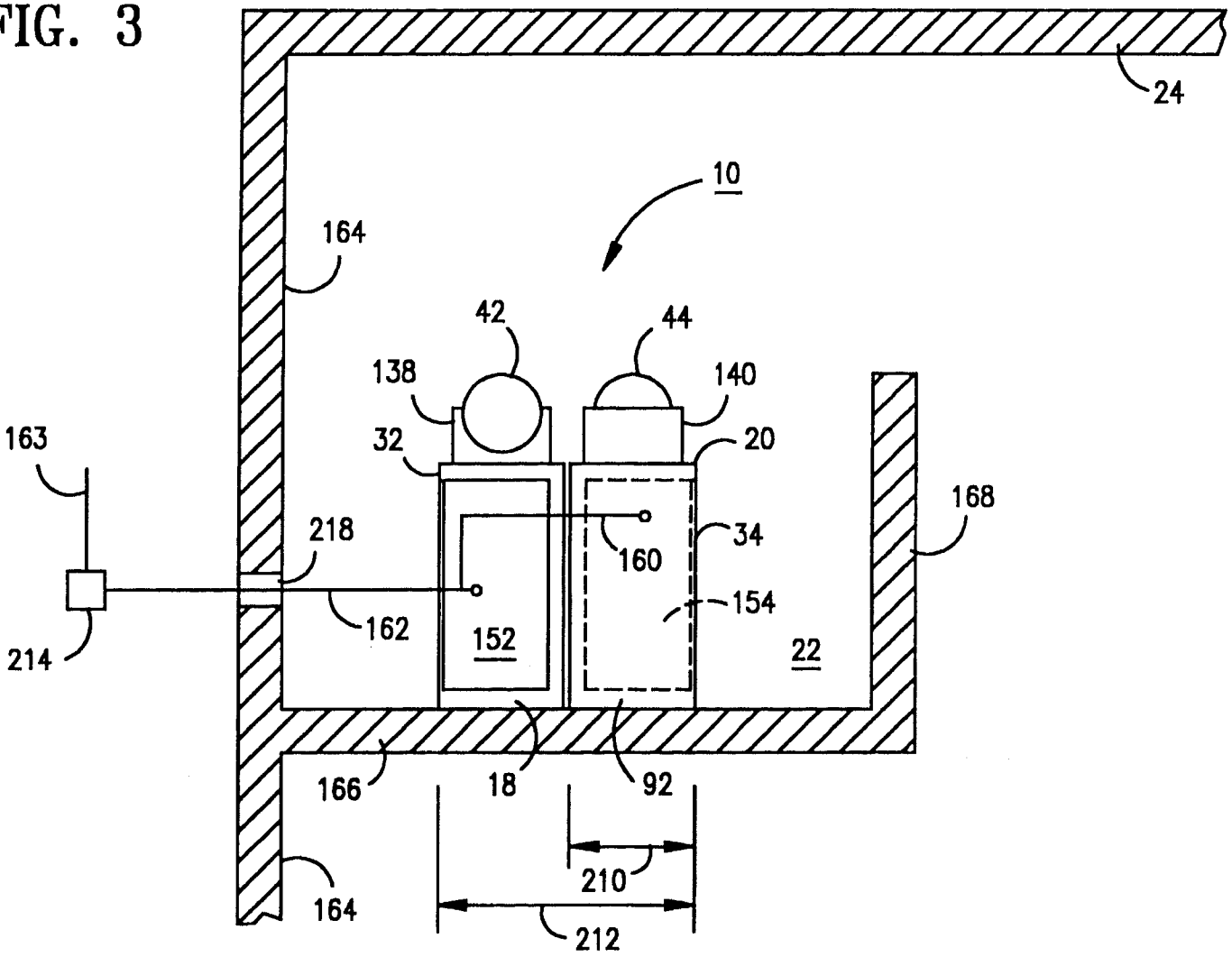
FIG. 3 is a schematic cross sectional view taken along the line 3—3 of FIG. 2.

Referring now to the drawings, wherein like reference numerals indicate like elements, there is shown in FIGS. 1–3 a modular lighting system 10 constructed in accordance with a preferred embodiment of the present invention. The lighting system 10 includes a plurality of straight and curved light fixtures 12, 14, 16, 18, 20. The system 10 is located within a cove 22 (FIGS. 2 and 3) and is arranged to illuminate a ceiling 24 (FIG. 3).

Each light fixture 12, 14, 16, 18, 20 has a casing 26, 28, 30, 32, 34 and a cold cathode lamp 36, 38, 40, 42, 44. Each lamp 36, 38, 40, 42, 44 has a tubular light transmitting body 46, 48, 50, 52, 54 and opposite opaque ends 60, 62, 64, 66, 68, 70, 72, 74, 76. As illustrated in FIGS. 1 and 2, the fixtures 12, 14, 16, 18, 20 are staggered such that the tubular light transmitting bodies 46, 48, 50, 52, 54 are slightly overlapped. Thus, the lamps 36, 38, 40, 42, 44 work together to uniformly illuminate the ceiling 24 along the entire length of the cove 22, with no bright spots and no dark spots.

Each casing 26, 28, 30, 32, 34 has an aluminum extruded main portion 78, 80 with an upper opening 82, inwardly directed, longitudinally extending lower flanges 84, 86, and inwardly directed, longitudinally extending top hooks 88, 90. A vertical, rectangular end plate 92 covers each of the ends 94, 96, 98 of the casings 26, 28, 30, 32, 34. For clarity of illustration, only one of the end plates 92 is shown in FIG. 1. The end plates 92 each have a lower flange (not illustrated) snugly received under the flanges 84, 86 of the extruded main portions 78, 80 to hold the end plates 92 in position.

Each casing opening 82 is closed by a cover 100, 102, 104, 106, 108. Each cover 100, 102, 104, 106, 108 has downwardly directed, longitudinally extending hooks 110, 112 that snap-fit into the top hooks 88, 90 to releasably connect the covers 100, 102, 104, 106, 108 to the respective main casing portions 78, 80.

Each of the casings 26, 28, 30, 32, 34 may be extruded of lightweight aluminum in accordance with Norbert Belfer Lighting Specification No. 2801, a copy of which is contained in U.S. Disclosure Document No. 297,167, filed Dec. 23, 1991. The entire disclosure of U.S. Disclosure Document No. 297,167 is incorporated herein by reference.

The covers 102, 106 for the curved fixtures 14, 18 may each be formed of two separate cover elements 111, 113 with angled adjoining ends 114, 116. Support elements 118, 120 may be located adjacent the corner formed by the angled ends 114, 116 for supporting the middle portions of the curved tubular light transmitting bodies 48, 52. Further, each curved casing 28, 32 may be formed of two separate extruded elements connected together at the corner by a suitable connecting means 122.

Bi-pin electrical sockets 124, 126, 128, 130, 132, 134, 136, 138, 140 (or single pin sockets, not shown) extend upwardly from the ends of the casings 26, 28, 30, 32, 34. The sockets 124, 126, 128, 130, 132, 134, 136, 138, 140 are used to supply electrical power through the bi-pin electrical contacts 142, 144 for the lamps 36, 38, 40, 42, 44 and to support the lamps 36, 38, 40, 42, 44 above the covers 100, 102, 104, 106, 108.

Suitable ballasts 150, 152, 154, 156, 158 (FIGS. 1 and 3 to 6 are provided for controlling the electrical power supplied to the lamps 36, 38, 40, 42, 44, particularly for limiting current through the respective lamps 36, 38, 40, 42, 44 and/or for providing starting voltages for the respective lamps 36, 38, 40, 42, 44. The ballasts 150, 152, 154, 156, 158 may be located within the casings 26, 28, 30, 32, 34. This way, each fixture 12, 14, 16, 18, 20 is a fully self-contained unit, which makes the system easy to install. Prewired leads (not illustrated) for the ballasts 150, 152, 154, 156, 158 are electrically connected to the sockets 124, 126, 128, 130, 132, 134, 136, 138, 140 by suitable electrical wires (not illustrated). The ballasts 150, 152, 154, 156, 158 are connected together in parallel to a common source of electrical power (not illustrated) by suitable electrical wires 160, 162.

A preferred ballast for use with the modular lighting system 10 is a highly reliable, cool running magnetic ballast produced by Magnatek/Jefferson of Elk Grove Village, Ill. The preferred ballast can be used for most of the differently sized and shaped fixtures 12, 14, 16, 18, 20. The preferred ballast can be tapped at any one of three different places as desired to match its lamp. In a preferred embodiment of the invention, the ballasts 150, 152, 154, 156, 158 and lamps 36, 38, 40, 42, 44 are arranged to operate at approximately six hundred volts. A seventy two inch fixture (not shown) will operate off a separate one thousand volt ballast.

Referring now to FIG. 3, the cove 22 is located adjacent a wall 164 and includes a molding with a base portion 166 and a front portion 168. The base portion 166 extends inwardly from the wall 164 and is substantially parallel to the ceiling 24. The fixtures 12, 14, 16, 18, 20 are supported by the base portion 166. The front portion 168 extends upwardly from the base portion 166 so that the fixtures 12, 14, 16, 18, 20 are not visible to people within the residential space, and so that light from the fixtures 12, 14, 16, 18, 20 reaches the room only indirectly by reflection off the ceiling 24.

Figure 4:
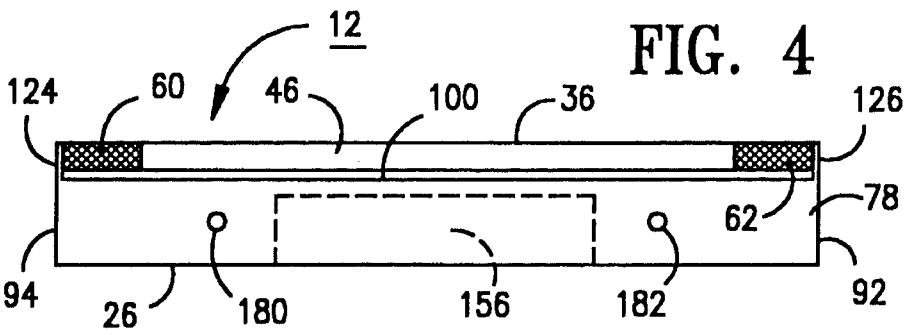
FIG. 4 is a side view of a short lighting fixture for the system illustrated in FIG. 2.
Figure 5:
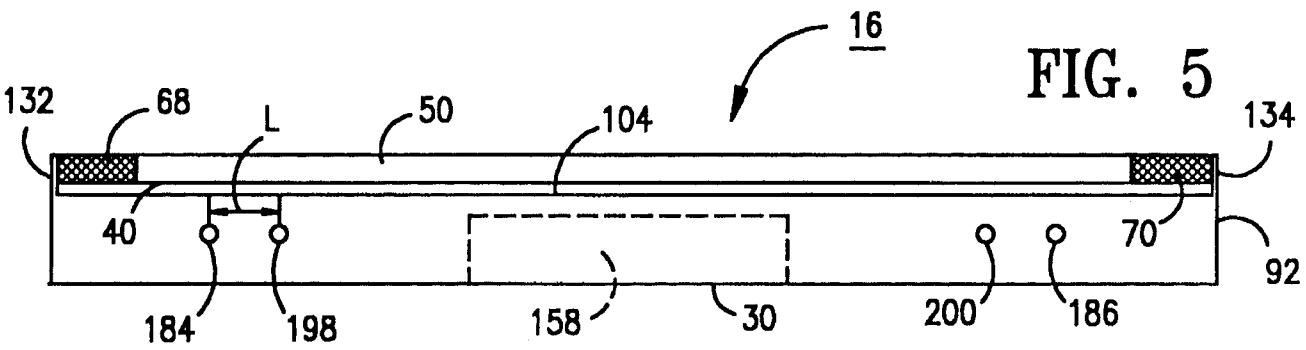
FIG. 5 is a side view of a medium lighting fixture for the system illustrated in FIG. 2.
Figure 6:
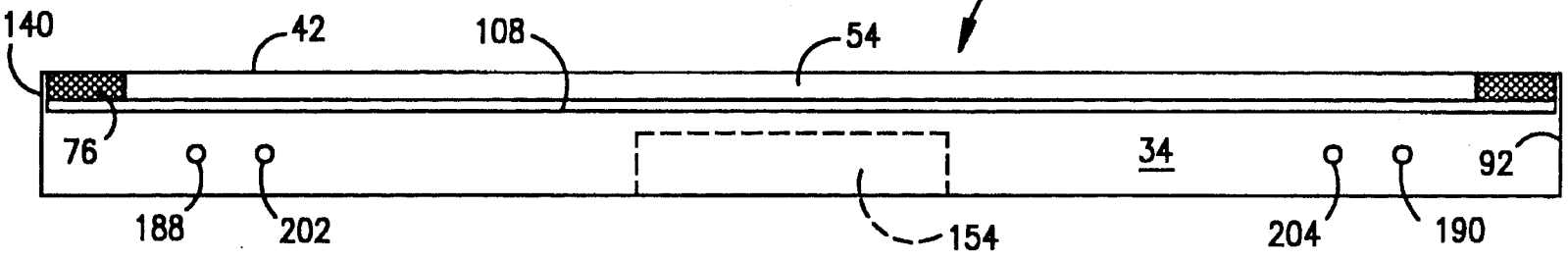
FIG. 6 is a side view of a long lighting fixture for the system illustrated in FIG. 2.

As illustrated in FIGS. 4–6, openings 180, 182, 184, 186, 188, 190 are provided through the casing sidewalls. The openings 180, 182, 184, 186, 188, 190 are used to align the casings 26, 28, 30, 32, 34 with respect to each other in the staggered format shown in FIGS. 1–3. The openings 180, 182, 184, 186, 188, 190 also provide passageways for the electrical conduits which connect the ballasts 150, 152, 154, 156, 158 together in parallel. Dashed lines 192, 194, 196 in FIG. 2 schematically designate the locations of the passageways formed by the alignment openings 180, 182, 184, 186, 188, 190.

As illustrated in FIGS. 5 and 6, the medium and long fixtures 16, 20 may be provided with additional alignment holes 198, 200, 202, 204 to accommodate cove lengths that are not divisible by the lengths of the illustrated straight and curved fixtures 12, 14, 16, 18, 20. Of course, when the additional holes 198, 200, 202, 204 are used to align the fixtures 12, 14, 16, 18, 20, a substantial overlap between adjacent light transmitting bodies will occur. The length of the overlap will be equal to the distance L between the primary alignment openings 184, 186, 188, 190 and the additional alignment openings 198, 200, 202, 204 (or two times the distance L). A light shield (FIGS. 9–11) may be used to eliminate the bright spot that would otherwise result from the use of the additional alignment openings 198, 200, 202, 204, as explained in more detail below.

Figure 17:
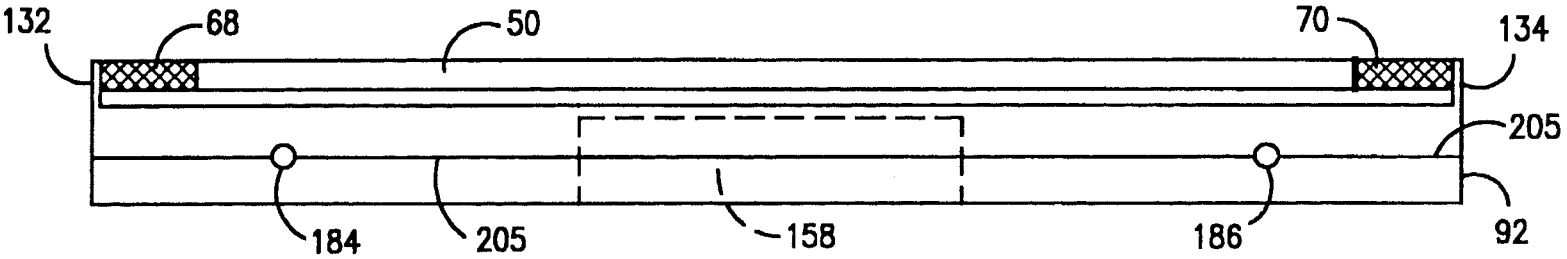
FIG. 17 is a side view of another lighting fixture for use in the system illustrated in FIG. 2.

In an alternative embodiment of the invention, illustrated in FIG. 17, the fixtures 12, 16, 20 may be provided with drill guides 205, each guide being in the form of a small groove running the length of the outside long axis of the respective extrusion. With the embodiment illustrated in FIG. 17, the ideal amount of stagger is achieved by aligning the fixtures according to the preformed openings 180, 182, 184, 186, 188, 190. If an installer needs to increase the amount of stagger, to reduce the overall length of the installation, for example to accommodate a shorter than anticipated "as built" cove length, he simply increases the amount of stagger between the last two fixtures, marks where the wires will enter the last fixture (the overly staggered fixture) and drills a hole through the side wall of the last fixture at the point of alignment with the preformed opening of the next-to-last fixture. The drill guide 205 is used to ensure that the opening drilled through the side wall of the last fixture is vertically aligned with the preformed opening of the next-to-last fixture. To eliminate the bright spot that would otherwise result from the over staggered arrangement described above, a light shield (FIGS. 9–11) may be used, as explained in more detail below.

The fixtures 12, 14, 16, 18, 20 preferably have a very small width 210 (FIG. 3). For example, the fixture width 210 may be no more than about one and three-quarters inches, such that the staggered width 212 of the lighting system 10 is no more than about three and one-half inches. Advantageously, the staggered width 212 of the lighting system 10 may be significantly smaller than the staggered width of cove lighting systems formed of conventional fluorescent fixtures, which is typically in excess of six inches.

In a preferred embodiment of the invention, the fixtures 12, 14, 16, 18, 20 would each be produced in relatively large quantities and in different colors. A lighting installer would then measure the cove within which the cove lighting system is to be installed, and then select the types and numbers of modular fixtures needed to fit the cove. The fixtures would not have to be specially manufactured for the cove.

The installation process for the system 10 may be as follows: First, the casing main portions 78, 80 are placed on the main portion 166 of the cove 22, and are staggered such that the openings 180, 182, 184, 186, 188, 190, 198, 200, 202, 204 of adjacent fixtures are aligned. The prewired leads of the ballasts 150, 152, 154, 156, 158 are then threaded through the aligned openings 180, 182, 184, 186, 188, 190, 198, 200, 202, 204 to connect the ballasts 150, 152, 154, 156, 158 together in parallel. The ballasts 150, 152, 154, 156, 158 are then connected to a common source of electrical power. The ballasts 150, 152, 154, 156, 158 may also be connected to one or more dimmers, as explained in more detail below. The electrical connections between the ballasts 150, 152, 154, 156, 158 and the sockets 124, 126, 128, 130, 132, 134, 136, 138, 140 are preferably factory installed. Preferably, the installer only has to make the connections between the ballasts 150, 152, 154, 156, 158 and the common connection to the source of electrical power. The extruded covers 100, 102, 104, 106, 108 are then snapped onto the main portions 78, 80 to cover the openings 82, and then the ends of the lamps 36, 38, 40, 42, 44 are located within the sockets 124, 126, 128, 130, 132, 134, 136, 138, 140.

A suitable dimming system 214 (FIG. 3) may be provided for controlling the electrical power supply to the light fixtures 12, 14, 16, 18, 20. The dimming system 214 is connected to the light fixtures 12, 14, 16, 18, 20 by suitable electrical conduits 160, 162 extending through a suitable opening 218 in the wall 164. In a preferred embodiment of the invention, the lamps 36, 38, 40, 42, 44 can be uniformly and simultaneously dimmed from full brightness to a faint glow.

The fixtures 12, 14, 16, 18, 20 can be made to dim uniformly together by providing each lamp 36, 38, 40, 42, 44 with a matched ballast and gas composition. A two step process may be employed to ensure that the fixtures 12, 14, 16, 18, 20 are uniformly dimmable: First, a ballast is selected for each lamp. Second, the composition of the gas contained within the lamp (including the make-up and pressure of the gas) is adjusted so that all of the gas discharge lamps dim evenly together.

A testing system (not illustrated) may be provided for testing the ballast selection and gas adjustment. The testing system includes a dimmable power source and a milliamp meter. To test a fixture, the fixture is connected to the dimmable power source and the power source is operated according to a predetermined dimming pattern. Light output is measured in terms of the lamp's operating current. Lamp current or current density is proportional to brightness. The higher the lamp current, the brighter the lamp. Thus, the decreasing intensity of light produced by the fixture is indirectly measured by the milliamp meter and compared to a predetermined desired operating current milliamp pattern. If the fixture does not provide the desired pattern, the ballast may be exchanged for another ballast and/or the composition of the gas may be adjusted and then the fixture may be re-tested. This process may be repeated as many times as necessary until the dimming of the fixture by the power source matches the desired pattern. Preferably, the dimmer should be able to increase or decrease the operating current of the lamps from approximately one hundred milliamps to approximately 5 milliamps evenly with no more than a plus or minus ten percent variation between different fixtures.

Figure 7:
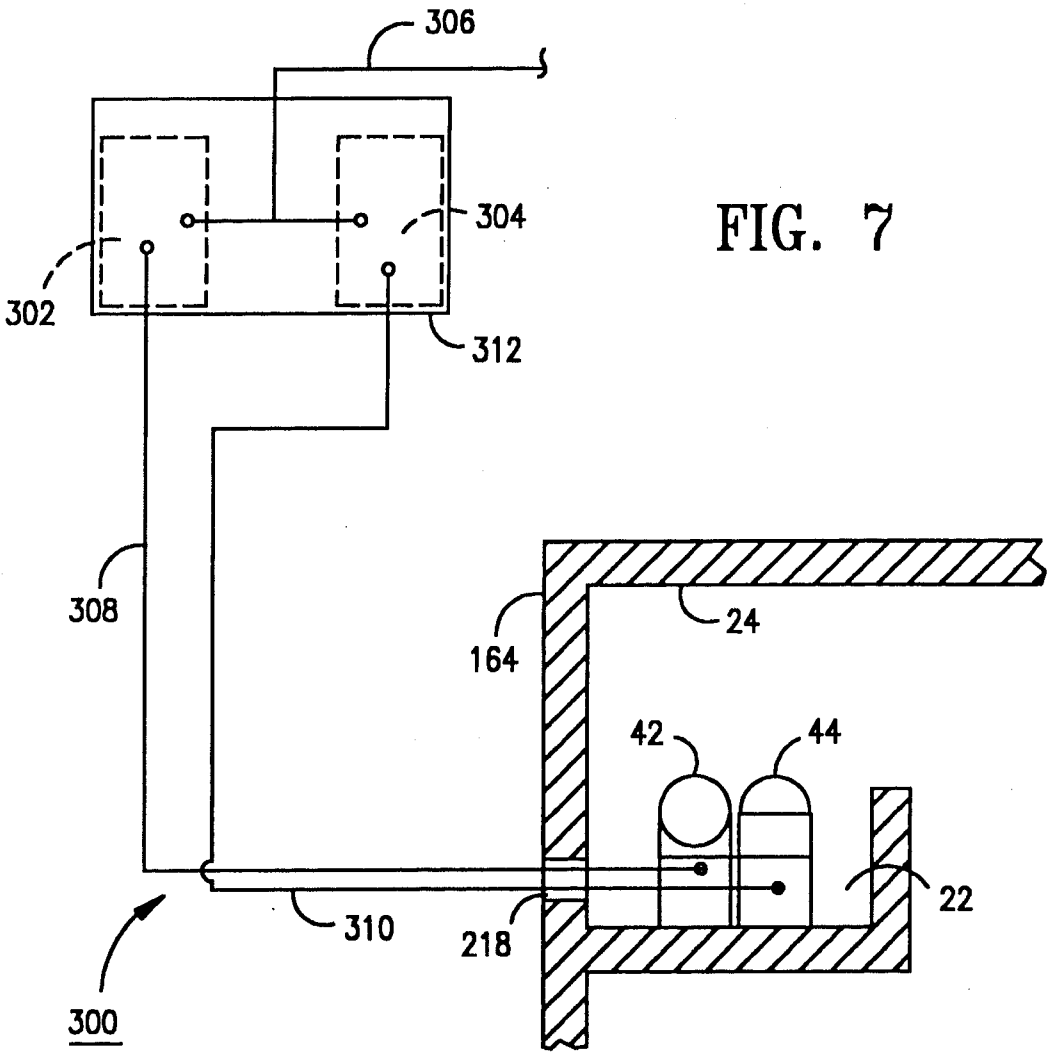
FIG. 7 is a schematic view of a lighting system constructed in accordance with another preferred embodiment of the present invention.

FIG. 7 illustrates another modular lighting system 300 constructed in accordance with the present invention. The system 300 illustrated in FIG. 7 is similar to the system 10 illustrated in FIGS. 1–6, except that the ballasts 302, 304 for the FIG. 7 embodiment are located outside the cove 22. Locating the ballasts 302, 304 outside the cove 22 may be helpful in reducing the dimensions of the lighting system 300. The ballasts 302, 304 may be identical to the ballasts 150, 152, 154, 156, 158 for the FIGS. 1–6 embodiment. Suitable means 306 may be provided for connecting the ballasts 302, 304 to a single source of electrical power (not illustrated). Suitable electrical conduits 308, 310 for connecting the ballasts 302, 304 to the lighting system 300 may extend through a suitable opening 218 in the wall 164. A housing 312 for enclosing the ballasts 302, 304 may also be provided.

Figure 8:
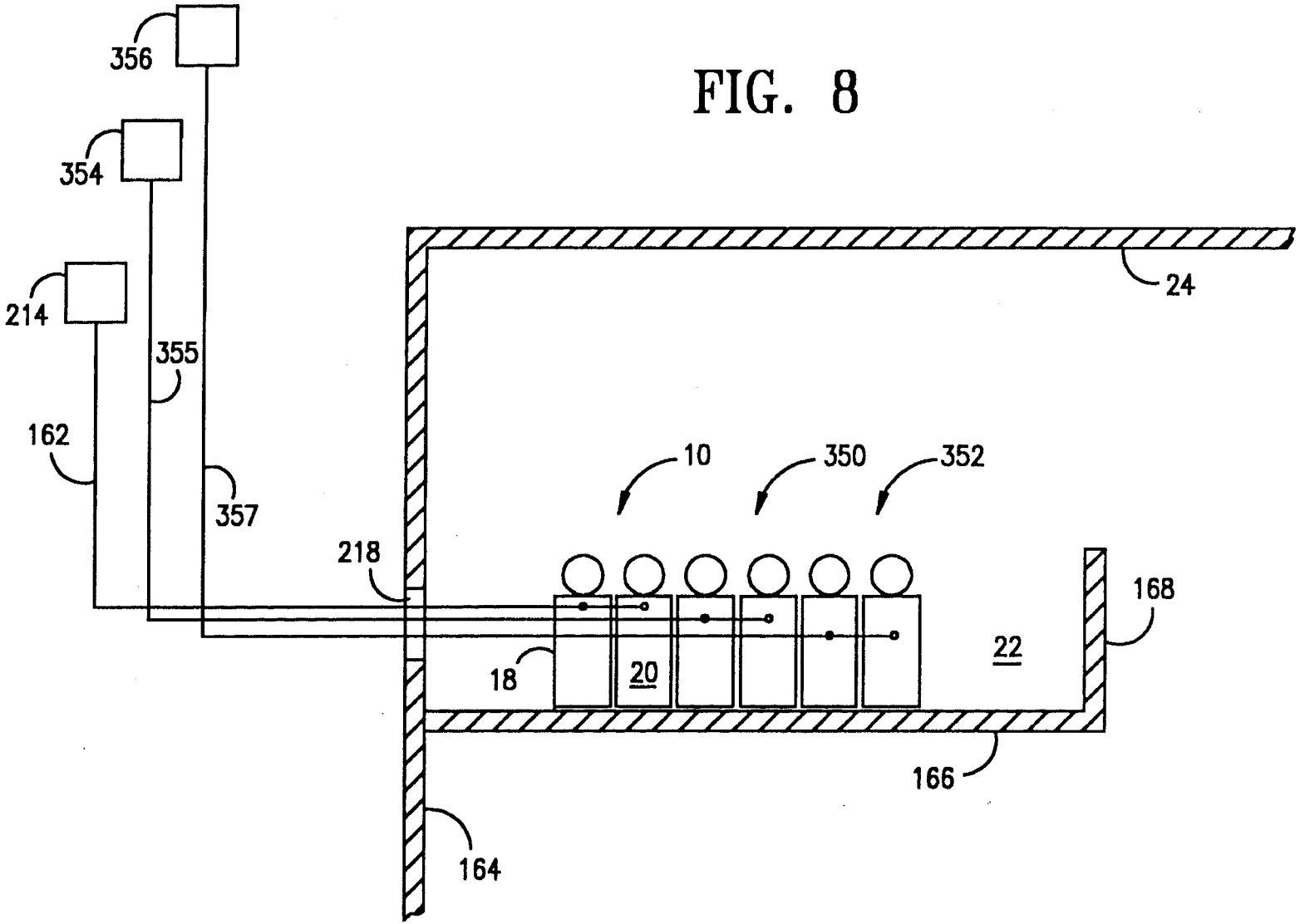
FIG. 8 is a schematic view of a lighting system constructed in accordance with another preferred embodiment of the present invention.

Referring now to FIG. 8, in another embodiment of the invention, several lighting systems 10, 350, 352 are installed next to each other within a light cove 22. the systems 10, 350, 352 are essentially identical to each other except that they produce different colors. The light systems 10, 350, 352 may produce blue, pink and white component colors, respectively. Each lighting system 10, 350, 352 has its own dimming system 214, 354, 356. The dimming systems 214, 354, 356 are connected to the respective lighting systems 10, 350, 352 by suitable electrical conduits 216, 355, 357. By controlling the intensity of the component colors generated by the systems 10, 350, 352, by selectively operating one or more of the dimming systems 214, 354, 356, a practically infinite range of resultant colors may be produced.

Figure 10:
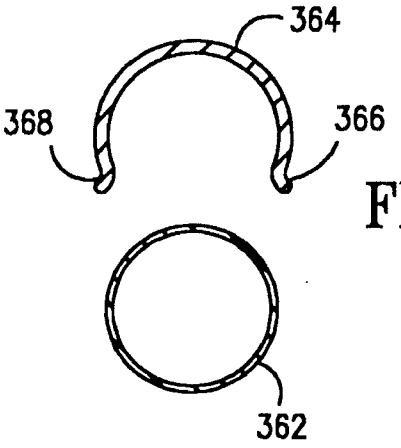
FIG. 10 is a broken away cross sectional view of the cover and overlapped lamp portion of FIG. 9, taken along the line 10—10 of FIG. 9. Elements of the lighting system other than the cover and overlapped lamp portion are not shown in FIG. 10.
Figure 11:
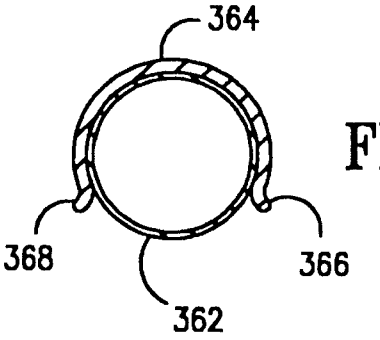
FIG. 11 is a cross sectional view of the cover and overlapped lamp portion of FIG. 10, in an assembled condition.
Figure 9:
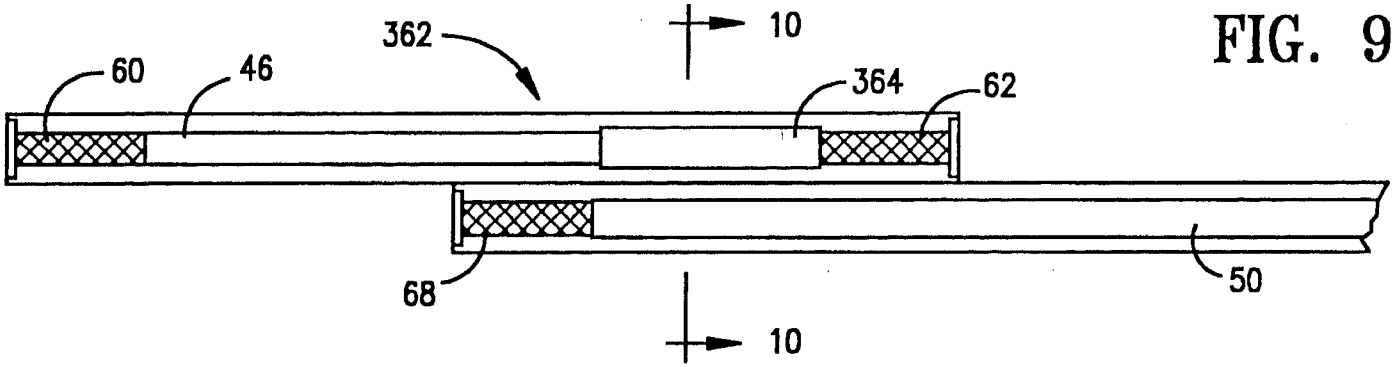
FIG. 9 is a plan view of a lighting system constructed in accordance with another preferred embodiment of the present invention.

Referring now to FIGS. 9–11, there may be times when the modular fixtures 12, 14, 16, 18, 20 do not fit within the cove 22 without a substantial overlap 362 between adjacent light transmitting bodies. As discussed above in connection with FIGS. 4–6, the length of the overlap 362 may be equal to a multiple of the distance L between the primary openings 180, 182, 184, 186, 188, 190 and the additional openings 198, 200, 202, 204. As discussed above in connection with FIG. 17, the length of the overlap 362 may be equal to the distance between the opening drilled through the drill guide 205 during installation and the adjacent preformed opening of the same fixture.

A C-shaped shield 364 (FIGS. 9–11) may be used to cover the overlapped lamp portion 362. The shield 364 may be formed of plastic so as to be lightweight and inexpensive.

The shield 364 may have a constant cross section. The shield 364 may be extruded and then field cut down to the length of the overlapped portion 362.

As illustrated in FIGS. 10 and 11, the shield 364 has a C-shaped cross section with radially outwardly turned edges 366, 368. The inner diameter of the shield 364 is substantially equal to the outer diameter of the light transmitting portion 362. Assembly is accomplished by simply pushing the shield 364 down onto the overlapped lamp portion 362. The edges 366, 368 resiliently separate and then return to their original positions to hold the shield 364 in place.

Figure 12:
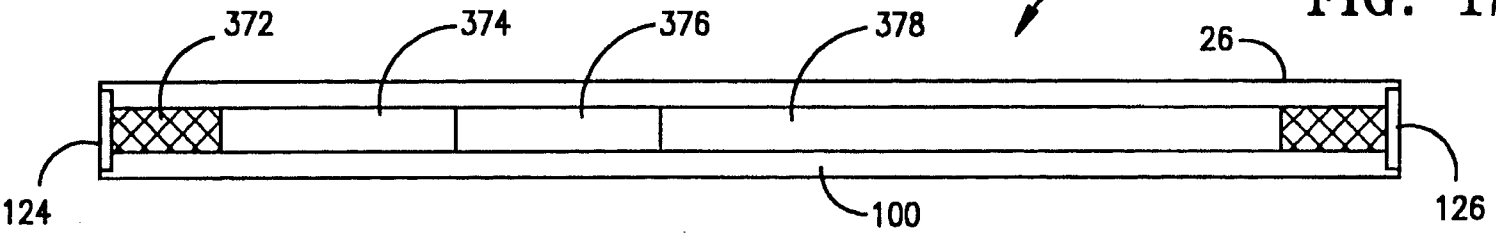
FIG. 12 is a plan view of a multi-color light fixture constructed in accordance with another preferred embodiment of the present invention.

FIG. 12 illustrates a multicolor gas discharge light fixture 370. The fixture 370 includes a casing 26 and a cold cathode lamp 372. The light fixture 370 is essentially like the straight light fixtures illustrated in FIGS. 4–6, except that the tubular light transmitting body for the multicolor fixture 370 consists of three or more different tubular sections 374, 376, 378 spliced together. Each of the sections 374, 376, 378 produces a different color. The sections 374, 376, 378 may be formed of different colored transparent material and/or may be lined with different phosphorescent materials. Thus, the fixture 370 produces linear illumination with more than one color.

FIGS. 13–16 illustrate a system for recessing a gas discharge light fixture 12 into a wall, ceiling or the like. The illustrated system includes a valance 380 arranged to fit over a light fixture casing 26. The valance 380 has an opening 382 for receiving the light fixture lamp 36. The dimensions of the opening 382 are equal to the outer dimensions of the casing 26. A flange structure extends around the periphery of the opening 382. The flange structure includes parallel side flanges 386, 388 and parallel end flanges 390, 392. Holes 384 extend through the side flanges 386, 388 to receive screws (not illustrated) for attaching the valance 380 to the sides of the casing 26. The flanges 386, 388, 390, 392 are integrally connected to a planar skirt portion 394. As illustrated in FIGS. 15 and 16, the casing 26 may be located within a suitable opening in a wall 396 with the planar skirt portion 394 flush with the interior of the wall 396.

As illustrated in detail in FIG. 14, covers 400 may be provided for concealing the ends of the recessed light fixture 12. Each cover 400 has an open front (not illustrated), a closed back end 402, opposite side walls 404, 406 and a top 408. Identical teeth 410 may be provided at the bottom edge of each of the side walls 404, 406 for engaging respective openings 412 in the top of the casing 26. The teeth 410 snap fit into the openings 412 to removably connect the cover 400 to the casing 26.

The valance 380 and the covers 400 may be used together to provide a safe and attractive recessed light fixture.

The above description and drawings are only illustrative of preferred embodiments which can achieve the objects, features, and advantages of the present invention. It is not intended that the invention be limited to the embodiments shown and described herein. Modifications of the invention coming within the spirit and scope of the following claims are to be considered part of the present invention.

What is claimed as new and desired to be protected by Letters Patent of the United States is:

1. A cold cathode cove lighting system located within a residential interior space, said interior space including a wall and a ceiling connected to said wall, said lighting system comprising:

a cove located adjacent to said wall and underneath said ceiling, said cove including a molding connected to said wall;

a first cold cathode lamp for illuminating said ceiling, said lamp being supported by said molding, said lamp being arranged to operate at a voltage of no more than about one thousand volts;

a second cold cathode lamp for illuminating said ceiling, said second lamp being longer than said first lamp, said second lamp being supported by said molding, said second lamp being arranged to operate at a voltage of no more than about one thousand volts; and a third cold cathode lamp for illuminating said ceiling, said third lamp being supported by said molding, said third lamp being curved, said third lamp being arranged to operate at a voltage of no more than about one thousand volts; and wherein an end of each of said first, second and third lamps overlaps an end of at least one other of said lamps, such that said ceiling is substantially uniformly illuminated by said lamps.

2. The lighting system of claim 1, wherein said molding includes a base portion and a front portion, said base portion being substantially parallel to said ceiling, said first, second and third lamps being located above said base portion, and wherein said front portion extends upwardly from said base portion toward said ceiling and conceals said lamps.

3. The lighting system of claim 1, wherein said molding includes a corner portion, said third lamp being located within said corner portion of said molding.

4. The lighting system of claim 1, further comprising first, second and third casings for supporting said first, second and third lamps, respectively, said casings being located on said molding.

5. The lighting system of claim 4, further comprising first, second and third ballasts electrically connected to said first, second and third lamps, respectively, said first, second and third ballasts being located within said first, second and third casings, respectively.

6. The lighting system of claim 4, further comprising first, second and third ballasts electrically connected to said first, second and third lamps, respectively, said ballasts being located outside of said cove.

7. The lighting system of claim 4, wherein each one of said casings includes an extruded main portion and an extruded cover.

8. The lighting system of claim 7, wherein said casings include side walls, and wherein said side walls include openings for aligning said casing and thereby aligning said lamps.

9. The lighting system of claim 8, wherein at least one of said side walls includes an elongated drill guide.

10. The lighting system of claim 8, wherein said third casing includes first and second ends, and first and second electrical sockets located at said first and second ends, respectively, said third lamp having pins received within said sockets.

11. The lighting system of claim 10, further comprising vertical end plates for covering said first and second ends of said third casing.

12. The lighting system of claim 11, wherein said cover for said third casing includes separate first and second cover elements, said cover elements being connected to said main portion of said third casing with a snap fit, and first and second support elements extending upwardly from said first and second cover elements, respectively, with a middle portion of said third lamp being supported by said support elements.

13. A method of dimming the cold cathode cove lighting system of claim 1, said method comprising the steps of:

simultaneously generating light of a first intensity from each of said lamps; and subsequently, simultaneously generating light of a second intensity from each of said lamps, said second intensity being less than said first intensity.

14. The system of claim 1, wherein said first lamp includes a tubular light transmitting body having a diameter greater than about three-quarters of an inch.

15. A method of manufacturing a lighting system, said method including the steps of:

connecting a first ballast to a first gas discharge lamp, said lamp having a tubular body;

subsequently, adjusting the composition of gas within said tubular body such that said lamp is dimmed by a dimming system according to a predetermined pattern.

16. The method of claim 15, further comprising the steps of connecting a second ballast to a second gas discharge lamp, said second lamp having a tubular body, and varying the composition of gas within said second lamp such that said second lamp is dimmed by said dimming system according to said predetermined pattern.

17. The method of claim 16, wherein said tubular body of said first lamp has a different configuration than said tubular body of said second lamp.

18. The method of claim 17, wherein said step of adjusting the composition of gas within said first lamp includes the step of adjusting the pressure within said first lamp.

19. A lighting system, comprising at least first and second light fixtures, each of said fixtures including a ballast and a gas discharge lamp, each lamp including a tubular body containing gas, and wherein said ballasts and the composition of said gas contained within said tubular bodies are matched such that said first and second light fixtures are dimmable together uniformly by a single dimming system.

20. The lighting system of claim 19, wherein said gas discharge lamps are cold cathode lamps.

21. The lighting system of claim 20, wherein said first light fixture is longer than said second light fixture.

22. The lighting system of claim 20, wherein said first light fixture is straight, said second light fixture being curved.

23. A modular system for generating light, said system comprising a plurality of fixtures, each fixture including a casing, a cold cathode lamp supported by said casing, and a ballast for providing power to said lamp, said ballast being located within said casing, and wherein said fixtures are electrically connected together in parallel, with each fixture being arranged to operate at a voltage of no more than about one thousand volts; and wherein said cold cathode lamps include a plurality of straight lamps and at least one curved lamp; and wherein said casings include a plurality of straight casings and at least one curved casing, wherein said straight lamps are supported by said straight casings, said ballasts for providing power to said straight lamps being located within said straight casings, and wherein said curved lamp is supported by said curved casing, said ballast for providing power to said curved lamp being located within said curved casing.

24. The modular system of claim 23, further comprising a single dimming system for simultaneously and uniformly controlling the intensity of light generated by said lamps, such that all of said lamps are dimmable together uniformly by said dimming system.

25. The modular system of claim 24, wherein said lamps are arranged to generate different colors.

* * * * *